US009754516B2

(12) United States Patent
Winter

(10) Patent No.: US 9,754,516 B2
(45) Date of Patent: Sep. 5, 2017

(54) COLOR FAN DECK WITH PAPER BLADES PAINTED ON BOTH SIDES

(71) Applicant: Steven B. Winter, Highland Park, IL (US)

(72) Inventor: Steven B. Winter, Highland Park, IL (US)

(73) Assignee: Color Communications, Inc., Chicago, IL (US)

( * ) Notice: Subject to any disclaimer, the term of this patent is extended or adjusted under 35 U.S.C. 154(b) by 4 days.

(21) Appl. No.: 15/170,691

(22) Filed: Jun. 1, 2016

(65) Prior Publication Data

US 2016/0275827 A1 Sep. 22, 2016

Related U.S. Application Data

(62) Division of application No. 13/959,118, filed on Aug. 5, 2013, now Pat. No. 9,393,823.

(60) Provisional application No. 61/680,901, filed on Aug. 8, 2012.

(51) Int. Cl.
*G09F 5/04* (2006.01)
*B41M 3/00* (2006.01)

(52) U.S. Cl.
CPC ..... *G09F 5/042* (2013.01); *B41M 3/005* (2013.01); *G09F 5/04* (2013.01)

(58) Field of Classification Search
None
See application file for complete search history.

(56) References Cited

U.S. PATENT DOCUMENTS

| | | | | |
|---|---|---|---|---|
| 4,379,696 | A * | 4/1983 | Lerner | B44C 1/172 206/472 |
| 4,457,718 | A | 7/1984 | Lerner | |
| 6,270,123 | B1 * | 8/2001 | Spangler | G01J 3/52 283/114 |
| 6,303,184 | B1 | 10/2001 | Lobo et al. | |
| 8,007,621 | B2 | 8/2011 | Winter | |
| 2002/0060058 | A1 | 5/2002 | Crook | |
| 2003/0188839 | A1 * | 10/2003 | Urscheler | D21H 19/82 162/123 |
| 2006/0257609 | A1 * | 11/2006 | Winter | B44D 3/003 428/40.1 |
| 2007/0109508 | A1 * | 5/2007 | Winter | B44D 3/003 353/95 |

(Continued)

OTHER PUBLICATIONS http://www.knowpap.com/www_demo/english/paper_technology/general/6_finishing/frame.htm; Nov. 2, 2005.*

(Continued)

*Primary Examiner* — Michael P Rodriguez
(74) *Attorney, Agent, or Firm* — Fitch, Even, Tabin & Flannery, LLP

(57) ABSTRACT

A color display fan deck which illustrates paint colors and a method for making the color display fan deck is described. The color display fan deck includes paper blades which has paint applied on each sized paper surface of each side of the blade. A plurality of planar swatch bearing blades is pivotally joined together at one end to form a deck or fan deck of paper blades painted on each side. The method includes sizing and painting a paper web on both sides with a water based paint having selected heat resistant pigments.

12 Claims, 4 Drawing Sheets

(56) References Cited

U.S. PATENT DOCUMENTS

| | | | | |
|---|---|---|---|---|
| 2007/0266901 | A1* | 11/2007 | Rance | C08L 3/02<br>106/501.1 |
| 2010/0128097 | A1 | 5/2010 | Sootome | |

OTHER PUBLICATIONS http://www.paper-paper.com/weight.html; 2005.*
http://www.knowpap.com/www_demo/english/paper_technology/general/6_finishing/frame.htm, Nov. 2, 2005.
http:///www.paper-paper.com/weight.html; 2005.

* cited by examiner

COLOR FAN DECK WITH PAPER BLADES PAINTED ON BOTH SIDES

This application is a divisional of prior application Ser. No. 13/959,118, filed Aug. 5, 2013, which claims the benefit of Provisional Application Ser. No. 61/680,901, filed Aug. 8, 2012, which are incorporated by reference herein.

FIELD

The present invention relates to color sample display devices for paint products where paint is illustrated on both sides of the device and to a method for making the color sample display device. More particularly, the present invention is directed to a color sample display device which is a color fan deck with a plurality of painted paper blades that display colors on each side of the color fan blade. The fans have blades which are pivotally joined together to form the fan or fan deck.

BACKGROUND

Paint colors often are displayed on color swatches mounted on a flat planar base which are joined together to form a deck or a fan deck with blades which are pivotally spread or fanned to display color. In the past, each blade in the deck had one or more color swatches which displayed one or more colors on one side of the blade. In order to display a large number of colors, either a plurality of individual swatches on each blade had to be made smaller or a larger number of individual blades with color swatches needed to be combined in a single deck. The resulting deck became rather large and cumbersome to transport and use.

Color display devices need to display colors attractively. The color displays on the individual fan blade color cards cannot be wrinkled and curled and swatches affixed to each side of the base of the blades must lay flat on the card or fan blades. In the past the flat planar mount base of the fan blade with swatches affixed thereto had to be fairly thick to avoid wrinkling and curling. This also increased the thickness of the fan with each blade displaying color only on one side of the fan blade. Further, it has been found that color swatches with paint coatings interfacing each other transferred color to the underlying or interfacing painted surface; hence, fan blades with color swatches on both sides risk transfer color to the underlying or interfacing blade surface. This is especially the case where dark colors transfer color to an underlying lighter colored painted surface.

U.S. Pat. No. 8,007,621 to Winter et al. addressed many of the problems described above by making a fan deck with blades which included painted polymeric film affixed to each side of the blade made of paper. The fan deck product described in the '621 patent provides a painted film/paper base/painted film laminate for each blade. However, to put paint directly onto both sides of a fan deck blade which is paper presents different problem from the laminated painted film/paper base/painted film blade described the Winter '621 patent. With a painted film/paper base laminate, opacity of the paper base blade/film was not a problem because white pigmented film could have paint applied thereon with the film providing a sufficiently opaque base for proper display of the paint. This made the film coated blade fairly easy to color match to the paint manufacturer's color. This color matching is critically important because (as is known) a manufacturer's paint generally is not used to make a color display product, but rather paint is custom made for the color display product. This custom paint then has to be color matched to the manufacturer's paint. Opacity, however, is not readily attained on a paper base, especially with certain colors. These colors include whites and light chromatic colors which have lower amounts of $TiO_2$.

While a fan blade with paint coated film had advantages in providing a film with opacity which made color matching easier, making the film coated blade presented other problems. Those problems included, air bubbles forming under the film, wrinkles in the film, film deforming during manufacturing the painted film/paper base blades, registration problems in matching paint boarders on film on both sides of the paper base blade. All of the latter created risk of making the painted film/paper base/painted film laminate blade unattractive.

Fan blades painted on both sides also may have been made in the past with pigments which included heavy metals such as lead. These pigments were very heat tolerant and could withstand high drying temperature without discoloration. Use of such pigments is now not permitted in much of the industrialized world. While disuse of such pigments solved toxicity problems in the world of color display products, the use of pigments without heavy metals are less tolerant of heat and have created problems with discoloration with drying using heat or elevated temperatures.

Making a paper painted blade (a blade having paint directly applied to a sized paper base of the fan blade) while solving some of the above problems, presented other unique manufacturing problems. Opacity had to be obtained. Further, one side of the paper had to be sized, the sized blade paper dried, and then painted and then again dried in a drier to dry the paint. To achieve the proper finish for all types of paints (flat or gloss), each side of the paper blade has to be sized, and in an important aspect sized at least twice, then dried, then painted and dried again. Moreover, the reverse or other side of the paper blade also has to be sized, in an important aspect sized twice, the sizing dried then painted and then the paint dried. This required the painted paper to be passed through a paint drying oven twice and counting the oven which dries the sizing, the web is exposed to heat drying at least three times. This could deleteriously affect some colors which have unstable pigments. These colors include yellow, orange and red which have a tendency to burn, but are used to make many custom paints for color display products which custom paints need to be color matched with the colors of the manufacturer's paint.

OBJECTS

An object is to provide a color display product which illustrates color on two opposite surfaces of a mount base.

Another object is to provide a color fan deck with a plurality of blades which can each display one or more different colors on each side of the fan blades.

Another object is to provide color fan deck having paper blades where the sized surfaces of the paper blades are painted on both sides of the fan blade, the blade not having a painted film applied thereto.

Another object is to provide a color fan deck with a plurality of color displaying painted paper fan blades where the painted paper blades have the color opacity and pigmentation (without heavy metals) to color match the commercial paint which the painted blades are supposed to illustrate.

A further object is to provide a method for making a color fan deck having a plurality of painted paper fan blades which display color on both sides of the blade.

These and other objects will become more apparent with reference to the description set forth below.

SUMMARY

Described herein is a color display product, and in one important aspect, a color display fan deck which illustrates paint colors and a method for making the color display fan deck. The color display fan deck includes paper blades which has paint having a binder which reacts to create a cured pigmented film applied on each sized paper surface of each side of the blade. A plurality of planar paint coated blades is pivotally joined together at one end to form a deck or fan deck of paper blades painted on each side without the use of a painted sheet of polymeric film or painted polymeric swatch on the fan blades. Since each painted blade can display a different color on each side of the blade, the fan deck of color cards can display twice as many colors as compared to a deck of color cards where each blade displays only one color or colors on one side of the blade. Use of paint coated paper to form blades of the fan deck avoids bubbles forming under paint coated polymeric film swatch, wrinkles in the film swatch, film deforming during manufacturing painted film/paper base/painted film blades, and registration problems in matching paint boarders on film on both sides of a paper base/blade.

In one aspect, each paint coated blade includes a flat elongated base paper (where one dimension is longer than the other) painted on both sides of the sized paper blade. In one important aspect, the paint covers substantially the entire surface of both sides of the painted blade and provides a fan blade with a durable flat surface that does not wrinkle or curl up on itself. With both sides of paper blades painted, printing can be done on both sides of the blade at once which reduces printing costs. With each blade displaying at least two different colors and using one half the usual numbers of blades to display the same number of paint colors, collating costs are reduced by half as compared to color fan decks which have blades which display color on one side of the blade. Moreover, as stated above, painted paper blades do not use a paint coated film swatch laminated to a paper base, but still are effective to illustrate color of the paint to color differences that are not generally detectable to a normal human eye viewing the color under the same illuminant (delta E less than or equal to about 2.3 and preferably about 1, this is called a just noticeable difference). Not using the painted film/paper/painted film laminate avoids bubbles forming under paint coated film swatch, wrinkles in the film swatch, film deforming during manufacturing a film/paint paper base blades, registration problems in matching paint boarder on film on both sides of a paper base/blade.

The L*a*b* color space or delta E described herein (also referred to as the CIELAB space) is one of the uniform color spaces defined by the CIE in 2000. The values of L*, a*, and b* are calculated according to the formulas below:

The color difference, or ΔE, between a sample color $L_2a_2b_2$ and a reference color $L_1a_1b_1$ is:

$$\Delta E = \sqrt{\left(\frac{\Delta L'}{K_L S_L}\right)^2 + \left(\frac{\Delta C'}{K_C S_C}\right)^2 + \left(\frac{\Delta H'}{K_H S_H}\right)^2 + R_T\left(\frac{\Delta C'}{K_C S_C}\right)\left(\frac{\Delta H'}{K_H S_H}\right)}$$

*where*

$$\bar{L}' = (L_1 + L_2)/2$$

-continued $$C_1 = \sqrt{a_1^2 + b_1^2}$$

$$C_2 = \sqrt{a_2^2 + b_2^2}$$

$$\bar{C} = (C_1 C_2)/2$$

$$G = \left(1 - \sqrt{\frac{\bar{C}^7}{\bar{C}^7 + 25^7}}\right)/2$$

$$a_1' = a_1(1 + G)$$

$$a_2' = a_2(1 + G)$$

$$C_1' = \sqrt{a_1'^2 + b_1^2}$$

$$C_2' = \sqrt{a_2'^2 + b_2^2}$$

$$\bar{C}' = (C_1' + C_2')/2$$

$$h_1' = \begin{cases} \tan^{-1}(b_1/a_1') & \tan^{-1}(b_1/a_1') \geq 0 \\ \tan^{-1}(b_1/a_1') + 360° & \tan^{-1}(b_1/a_1') < 0 \end{cases}$$

$$h_2' = \begin{cases} \tan^{-1}(b_2/a_2') & \tan^{-1}(b_2/a_2') \geq 0 \\ \tan^{-1}(b_2/a_2') + 360° & \tan^{-1}(b_2/a_2') < 0 \end{cases}$$

$$\bar{H}' = \begin{cases} (h_1' + h_2' + 360°)/2 & |h_1' - h_2'| > 180° \\ (h_1' + h_2')/2 & |h_1' - h_2'| \leq 180° \end{cases}$$

$$T = 1 - 0.17\cos(\bar{H}' - 30°) + 0.24\cos(2\bar{H}') + 0.32\cos(3\bar{H}' + 6°) - 0.20\cos(4\bar{H}' - 63°)$$

$$\Delta h' = \begin{cases} h_2' - h_1' & |h_2' - h_1'| \leq 180° \\ h_2' - h_1' + 360° & |h_2' - h_1'| > 180°;\ h_2' \leq h_1' \\ h_2' - h_1' - 360° & |h_2' - h_1'| > 180°;\ h_2' > h_1' \end{cases}$$

$$\Delta L' = L_2 - L_1$$

$$\Delta C' = C_2' - C_1'$$

$$\Delta H' = 2\sqrt{C_1' C_2'}\ \sin(\Delta h'/2)$$

$$S_L = 1 + \frac{0.015(\bar{L}' - 50)^2}{\sqrt{20 + (\bar{L}' - 50)^2}}$$

$$S_C = 1 + 0.045\bar{C}'$$

$$S_H = 1 + 0.015\bar{C}'T$$

$$\Delta\theta = 30\exp\left\{-\left(\frac{\bar{H}' - 275°}{25}\right)^2\right\}$$

$$R_C = \sqrt{\frac{\bar{C}'^7}{\bar{C}'^7 + 25^7}}$$

$$R_T = -2R_C\sin(2\Delta\theta)$$

$$K_L = 1 \text{ default}$$

$$K_C = 1 \text{ default}$$

$$K_H = 1 \text{ default}$$

A just noticeable difference (JND) is where delta E is less than about 2.3 and preferably less than about 1 as measured by a Datacolor Model 650® Bench Top spectrophotometer using Tools 2.0 quality control software, currently available from Datacolor, Lawrenceville, N.J., USA. The Datacolor Model 650® spectrophotometer is a dual beam d/80 spectrophotometer with a pulse xenon illumination source filtered to about D65 having a sphere diameter of 152 mm, with a transmittance, having a wavelength range of 360 nm to 700 nm, reporting at 10 nm intervals, a photometric range of 0 to 200%, 20 read repeatability of 0.01 (max DE CIELAB), Inter-instrument Agreement-Reflectance of 0.15 (max DE CIELAB), 0.08 (avg DE CIELAB), Inter-instrument Agreement-Regular Transmission at 550 nm±0.20% at 85% T, ±0.10% at 32% T; Inter-instrument Agreement-Transmission Haze Measurements ±0.15% at 10% TH, Aperture plates for reflection measurements are 4 standard (LAV, SAV, USAV, Barium-coated MAV) and 2 optional (MAV, XUSAV), Transmission Sampling Aperture Size 22 mm. The water based paint used to paint coat a paper base or substrate (to form the blades) includes a binder which reacts, such as by cross-linking to provide a cured pigmented film. The latter film is cured on the paper substrate as opposed to the preexisting painted film sheet applied to paper as described in U.S. Pat. No. 8,007,621 to Winter et al.

Prior to painting, each fan deck includes paper blades coated with water based paint with that paint on both sides of a base paper to form a blade of the fan deck. The water based paint includes a binder which reacts, such as by cross-linking, to provide a cured pigmented film. The latter paint is to be distinguished from a lacquer paint which uses an organic solvent as a dispersant which evaporates to provide a residual film which is not created by a chemical reaction. The pigmented film provided by the paint used in the process to make painted fan blades described herein is cured on the paper substrate as opposed to the preexisting painted film sheet applied to paper as described in U.S. Pat. No. 8,007,621 to Winter et al. The paper on which paint is applied has a caliper of from about 6 to about 12 mils, and preferably from about 8 to about 10 mils or from about 6 to about 12 points, and preferably from about 8 to about 10 points. The basis weight of the paper is from about 80 to about 160, and preferably from about 120 to about 145 pounds. In an important aspect, the paper is 8 to 10 point SBS board having a basis weight in the range of from about 120 for the 8 point paper to about 145 pounds for the 10 point paper. The paper is sized on each side with sizing in amounts effective to make the paint coated swatches amenable to the water base paint without the painted paper wrinkling or curling, but still maintain a delta E of less than or equal to about 2.3 and preferably less than about 1.

Prior to painting each side of the blades is sized twice via gravure printing rolls with a sizing dispersed in an organic solvent, the dispersion having a solids content of about 12 to about 25 percent by volume. In one aspect the sizing could be up to about 100% solids and curable by radiation such as UV radiation. In an important aspect, the gravure rolls are in line and the sizing is applied as two coats sequentially, one application on each side with one roll pair and another application with a second roll pair, each application applying from about 0.0002 to about 0.0004 inches of sizing, e.g. a total of about 0.0004 to about 0.0008 inches of sizing on each side. Alternatively each side of the web can be gravure printed with one gravure roll, then another on each side with the first gravure printing taking place before the first painting step and the second gravure printing taking place after the first painting step.

The plurality of color display blades is joined together with a screw or other fastener which permits each of the blades to be pivotally fanned or rotated to display the color on both sides of the fan deck blades. Each individual color display blade can be pivotally repositioned so that the color on each side of the blade can be viewed and compared with other colors and the environment for which the color is intended.

The method of making the fan deck described herein includes applying paint to the sized surface of a large web substrate of paper with a knife coater or roller/roller coater. In the method, the paper to be sized and paint coated is rolled from a roll as a web, sized via gravure printing with in line gravure printing rolls as described above. After twice coating with sizing, the sized web with sizing on each side is passed through an oven which has a temperature of from about 130° F. to about 160° F., preferably about 150° F. to 155° F. at a speed of from about 58 feet/minute to about 72 feet/minute with both sides of the sized web being dried in the oven for about 24 to about 30 seconds.

After the application of two coats of sizing on the paper web and drying the sizing and then paint coating on the first sized surface of the web, the paint coated paper web is rolled into a large roll and then unrolled to apply paint to the unpainted sized side of the web which is opposite to the paint coated first side of the web. The paint applied to the second surface of the web is dried in the same manner as the sizing previously applied to the opposite side of the web.

In an important aspect, the paint is water based paint with an acrylic binder resin which uses an acrylic polymer or copolymer binder having pigments which are stable such that there will be a color change that will effect a delta E of not greater than about 2.3 and preferably not greater than about 1 after being exposed to temperatures of at least about 185° F. for at least about 10 minutes, preferably at least about 200° F. for at least about 10 minutes (drying of the paint on each side of the web taking about 3.5 to about 5 minutes for each painted side of the web) as compared to being air dried at 68° F. Generally this type of water based paint is a water-latex emulsion having high gloss, and will not transfer color to interfacing fan blades such that there will be a color change that will affect a delta E will be greater than about 2.3 and preferably not greater than about 1. Moreover the paint on the blades should have good block resistance so that the paint surfaces will not stick to one another (when the blade faces touch each other when the fan deck is closed) at a temperature of about 120° F. The paint should also have a relatively high glass transition temperature (Tg) of from about 25° C. to about 100° C. at which a water-latex emulsion will form a film with external coalescence. A water-latex emulsion used to make the paint binders described herein which meets the criteria of such a paint binder resin is a methyl methacrylate-butylmethacrylate copolymer water-latex emulsion E-1630 sold by the Rohm and Haas Co., Philadelphia, Pa. This water latex emulsion has high gloss, good block resistance and a Tg of 50° C., a solids content of from about 44.5% to about 45.5% by weight and a specific gravity of 1.035.

In making the fan blades painted on both sides, the painted sized paper web moves through the drying oven having a temperature of from about 185° F. to about 220° F., preferably about 185° F. to about 200° F., at a speed of about 58 to about 72 feet per minute and spends a total time per painted side being dried for about 5 minutes, preferably to about 3.5 to about 4 minutes in the paint drying oven. Preferably the oven has temperature zones to bring the temperature up to dry the paint such that on average the temperature should not exceed 200° F. As the painted web moves through the oven, it is supported by a moving belt which moves at about the speed of the paint coated paper. The paint coating dries initially, and then as will be described below, is wrapped into a roll and then has its reverse side painted. It is at this step (which is described below) of drying the freshly painted reverse side of the web, the paint coated surface of the first painted side of the paper web may touch or rest on the moving belt and exposes that paint coated surface to scratching or marring. This risk is reduced or nearly completely eliminated by having a belt coated with a polymer that has a coefficient of friction of less than about 0.2 and generally from about 0.05 to about 0.2, preferably about 0.05 to about 0.1. When the belt is coated with the polymer only trace amounts of scratching of the paint is scratched as discerned by the human eye in a lighted room (e.g. at least less than 0.1% of the surface). Such polymers include polytetrafluoroethylene, fluorinated ethylene propylene, also known as FEP, and perfluoroalkoxy, also known as PFA.

The web sized and painted on its first side may be rolled up and the roll then may be repositioned to be unrolled to pass the web through the same knife coater used to paint the first sized side of the web on the first pass. In the second pass, the water based paint is applied to the "reverse" side of the now sized "reverse" web surface using the knife coater. The freshly painted "reverse" side of the web then is dried by passing it through an oven having a temperature of from about 185° F. to about 220° F., preferably from about 185° F. to about 200° F. at a speed of from about 58 feet/minute to about 72 feet/minute as described above. With each side of the painted web being dried, the painted web spends a total time of from about 7 to about 10 minutes being exposed to heat in a drying oven with the second pass of the web through the paint drying oven. It is during this second pass through the oven that the polymeric coated belt protects the paint which had been applied in the first painting step from scratching and marring.

After the application of the sizing and paint as described above, the painted web then is cut to into individual color display blades which are then collated and joined at one end using known techniques. Fastener openings may be cut in the color cards before or after collating. A deck of color cards is fastened together by inserting a fastener device through the color cards such that they are pivotably attached.

DETAILED DESCRIPTION

Figure 1:
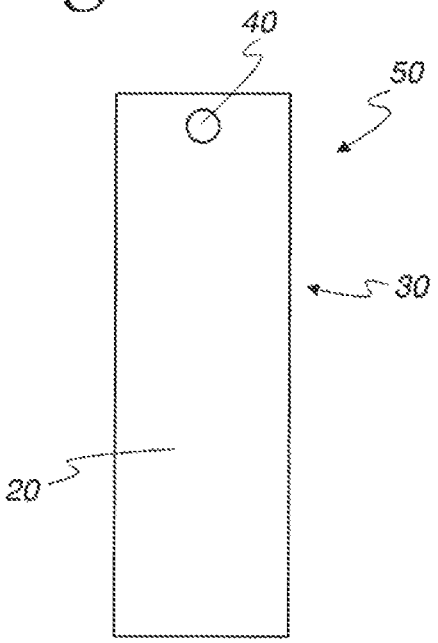
FIG. 1 is a top view of a fan deck with the individual blades precisely aligned on top of each other.

As illustrated in FIG. 1, a fan deck 50 includes a painted paper blade 20 with paint applied to both sides of a base paper 30 sized and painted on both sides. The fan deck 50 also includes an attachment opening 40 through which a screw or other suitable fastener may be put to hold a plurality of individual blades together so that the blades may be pivoted around the fastener as described below. The fan deck permits the use of relatively large paint coated swatches which can be used to provide a realistic display of paint color. Ideally, the individual fan blades 10 (FIG. 2) will be about 2 inches by about 8 inches or even larger.

Figure 2:
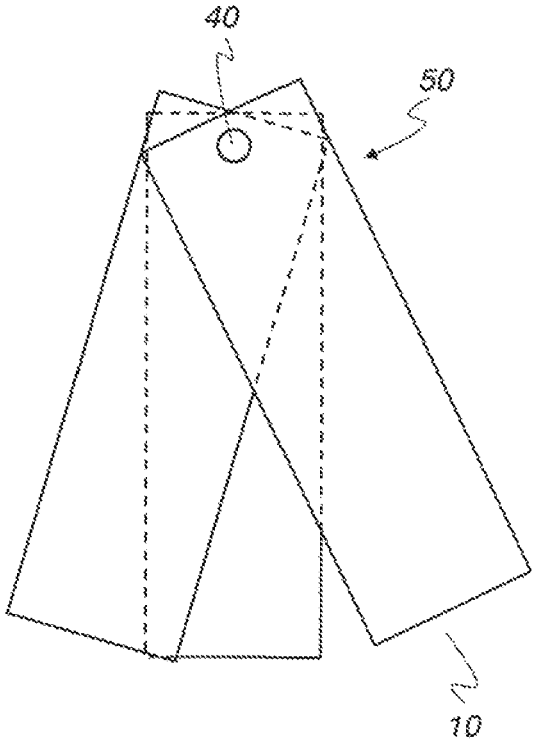
FIG. 2 is a top view of a color fan deck with the blades rotatably or pivotally moved so that the color on each side of the blade can be seen.

Referring to FIG. 2, a fan deck 50 includes a plurality of individual blades 10 which are attached through attachment opening 40 for pivotal rotation to open (and close) and "fan" the blade and the display color on both sides of the paint coated paper blades. As noted above, any type of fastener device such as a screw, rivet, nut and bolt, and the like may be inserted through the attachment opening 40 to secure the paint coated blades 10 together. With "fanning" or opening the fan deck, different fan blades in the deck may be viewed by pivotally rotating individual blades.

Figure 3:
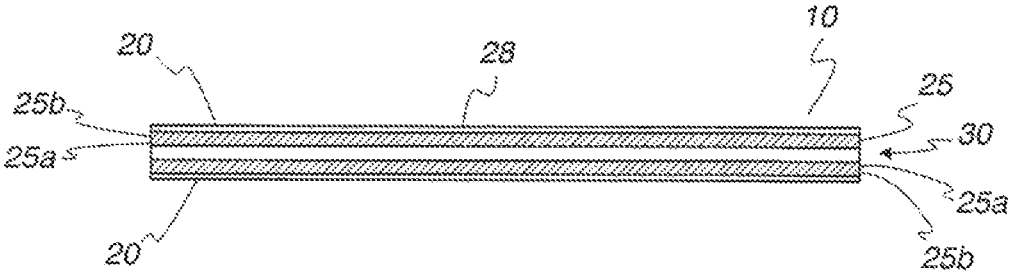
FIG. 3 is a side view of an individual fan blade.

FIG. 3 illustrates a side view of an individual blade 10 of the fan deck 50. A flat base paper 30 has sizing 25 in the form of two sizing layers 25*a* and 25*b* on both of its sides and has painted layers 28 on both sides of the sized base layer. The paint used to make the fan is a water dispersible or solvated with water. In an important aspect, the water based paint has an acrylic polymer or copolymer binder. For dark colors the amount of pigment relative to the amounts of binder resin (the resin which forms the film when the paint dries) is reduced (such as to provide a pigment to binder ratio of about 1 to about 5 for black) over that generally used for lighter colors (such as a pigment to binder ratio of about 1 to about 2 for white and a pigment to binder ratio of about 1 to about 3 for red) where the ratios of amounts of pigment to binder are effective to minimize transferring color to a lighter chip interfacing with the darker chip of an interfacing blade such that the colors will not deleteriously vary to provide a color variance as measured by a delta E of not greater than about 2.3 and preferably not greater than about 1. It has been found that without this aforedescribed technique, interfacing colors of paint coatings may transfer to one another and most particularly from dark to light paint.

Figure 4A:
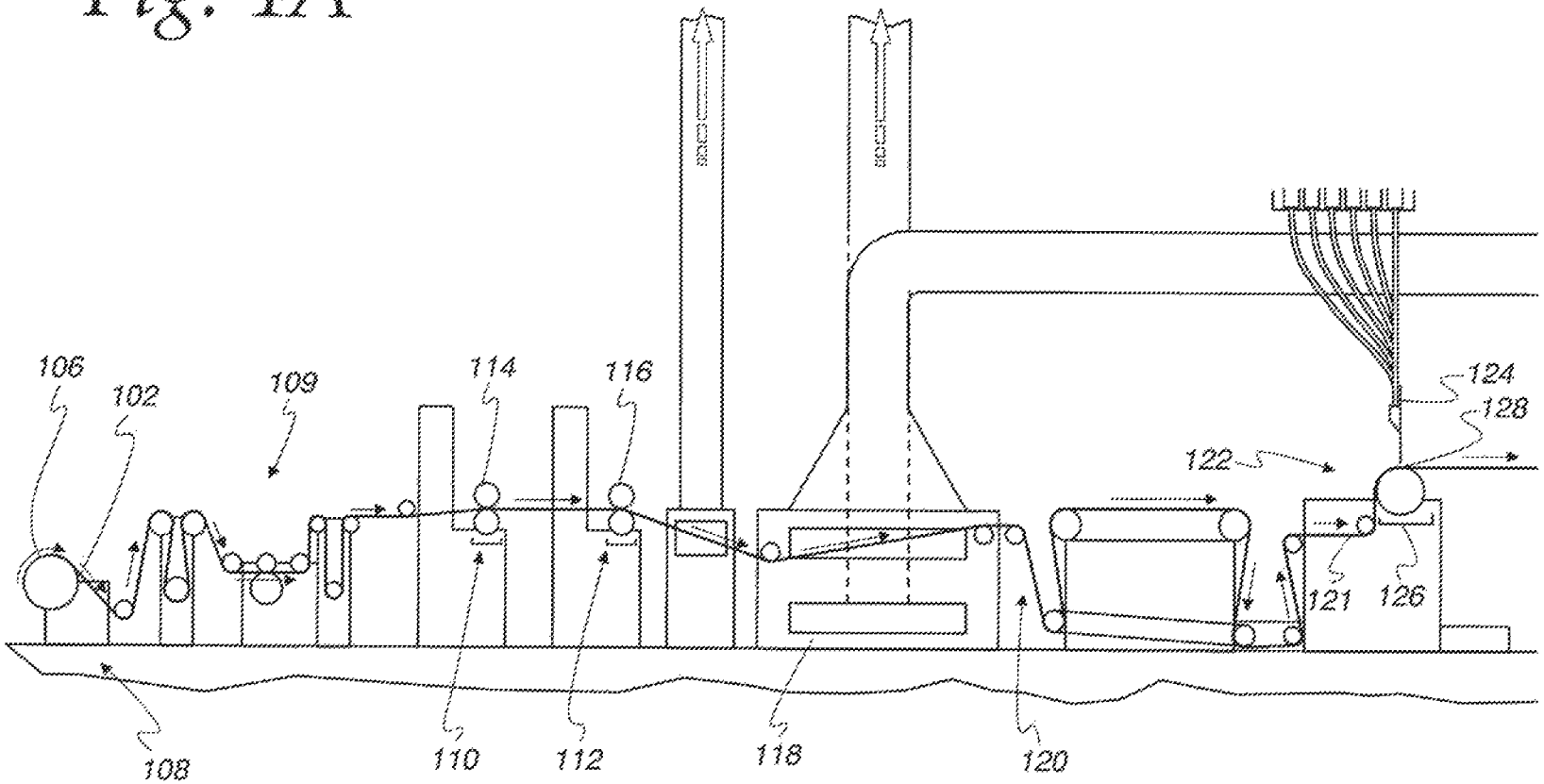
FIGS. 4A-4C individually comprise partial views that together according to the legend in FIG. 4C comprise a schematic view of the arrangement of equipment used in the method of making individual fan blades which are paint coated on both sides, the equipment including the gravure sizing rolls, sizing drier, paint over roll coater and paint drier.
Figure 4B:
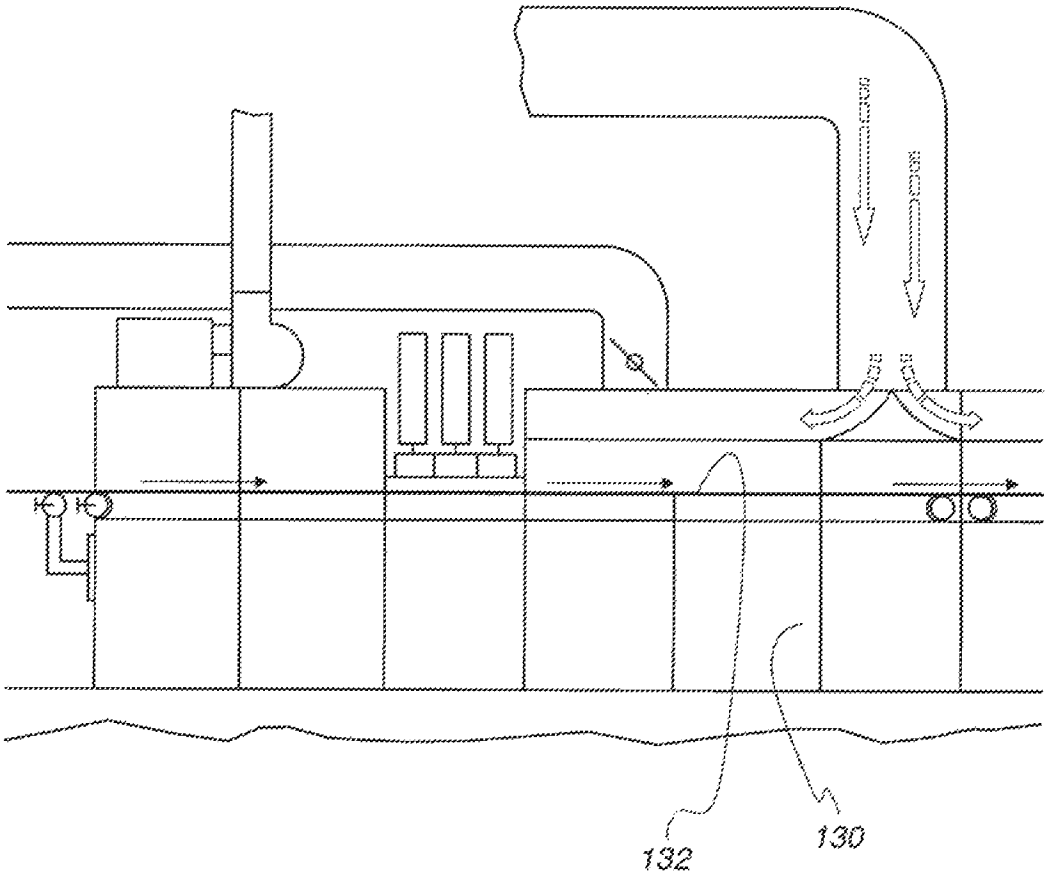
Figure 4C:
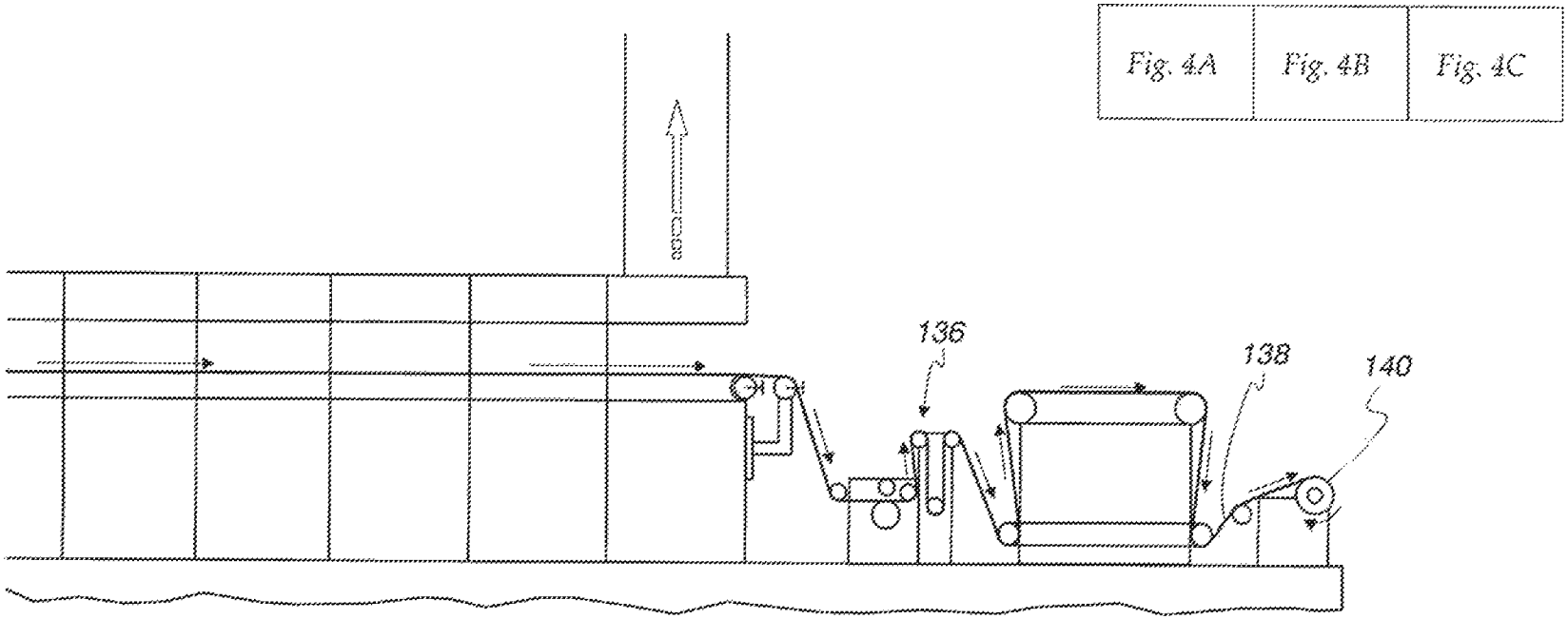

In making the fan deck and as shown in FIGS. 4 A through 4 C, a paper web is supplied as a large sheet or web 102 in a roll 106 which is unrolled as at 108 and positioned and tensioned by a plurality of tensioning rolls 109. Sizing is supplied by reservoirs 110 and 112 and is applied by gravure printing roll pairs 114 and 116 to the surface of the unrolled paper web substrate. The sizing is applied such that each roll pair applies between about 0.0002 to about 0.0004 inches of sizing. The sizing is dried by transmitting the sized web through a short sizing oven 118 that has a temperature in the range of from about 130° F. to about 160° F. with the sized web running through the oven at a rate of from about 58 to about 72 feet/minute to expose the web to the latter temperatures for about 24 to about 30 seconds. After the web, with the dried sizing emerges from oven 118, a plurality of tensioning rolls 120 move the dried sized web to a knife over roll coater 122. The surface of the web at 121 has paint applied thereto through lines 125 into spaces defined by fixtures or dies which are behind the knife 124. This creates a stripe effect with the paint. Excess paint is collected in reservoir 126. The paint on the surface of the web is spread by knife 124 as it passes between under roll 128 and knife 124. Paint is applied such that about one gallon of paint covers about 250 square feet to about 500 square feet of the paper web. Alternatively, a roller coater may be used in lieu of a knife coater.

After the water based paint is applied at the knife over roll coater, it is moved to a long oven 130 having a temperature of from about 185° F. to about 220° F., preferably from about 185° F. to about 200° F. and is moved through the oven at a speed of from about 58 feet/minute to about 72 feet/minute. The length in the oven is such that the web will spend from about 3.5 to about 5 minutes, preferably 4 minutes (per painted side) in the oven. The web is transmitted through the oven on belt 132 which is coated with a fluoro polymer having a coefficient of friction of less than about 2 and generally from about 0.05 to about 0.2. As the dried painted web exists the oven for the first time, it is wound around a plurality of tensioning rolls 136 and the painted web 138 is wound into roll 140. Thereafter the roll is moved to the beginning of the process line for unrolling, painting and paint drying to produce a dried paint layer on the reverse side of the web that had just been painted as described above.

The paint is water based paint with an acrylic binder resin which uses an acrylic polymer or copolymer binder. Generally this type of water based paint is a water-latex emulsion having high gloss, good block resistance when applied so that the paint chip surfaces will not stick to one another at a temperature of about 120° F., will not transfer color when applied and dried on fan blades when interfacing with each such that delta E will not be greater than about 2.3, and preferably not greater than about 1. The resin used to make to paint binder should have a relatively high glass transition temperature (Tg) of from about 25° C. to about 100° C. at which a water-latex emulsion will form a film with external coalescence and a solids content of from about 40 to about 50 weight percent. An important water based paint includes a water-latex emulsion is a methylmethacrylate-butylmethacrylate copolymer water-latex emulsion E-1630 sold by the Rohm and Haas Co., Philadelphia, Pa. This water latex emulsion has high gloss, good block resistance and a Tg of 50° C., a solids content of from about 44.5% to about 45.5% by weight and a specific gravity of 1.035. The methylmethacrylate-butylmethacrylate copolymer water-latex emulsion E-1630 sold by the Rohm and Haas Co., Philadelphia, Pa., has high gloss, good block resistance and a Tg of 50° C., a solids content of from about 44.5% to about 45.5% by weight and a specific gravity of 1.035.

An emulsion system which forms the paint binder is formed by combining the emulsion with a dispersant or dispersing agent forming from about 0.5 to about 1.5% by weight of the emulsion system; a non-ionic surfactant forming from about 0.2 to about 0.8% by weight of the emulsion system; a defoamer forming from about 0.25 to about 0.75% by weight of the emulsion system; a coalescent forming from about 2.5 to about 4.5% by weight of the emulsion system; an alkaline activator such as dimethylamino ethanol or ammonia to adjust the pH of the emulsion system to within a range from about 8.8 to about 10, wherein the alkaline agent generally forms about 0.4% by weight of the emulsion system; and water as is necessary to bring the emulsion system to 100% where the emulsion, such as the previously mentioned E-1630 water-latex emulsion, forms from about 40 to 60% by weight of the emulsion system. The dispersant such as Tamol 731 (which is a product of Rohm and Haas Co.), or others as are known in the art, reduces the tendency of the pigments to agglomerate. The surfactant such as Triton GR-7, Triton CF-10 (which are products of the Rohm and Haas Co.), or others as are known in the art, provides color and pigment stability. The coalescent, such as Texanol (which is a C12 ester alcohol and product of the Eastman Kodak Company), butyl benzoate, dimethyl adipate, or others as are known in the art, promotes the coalescence of the particles of the emulsion into a paint film. The defoamer such as Foam Master DS and AP defoamer (which are products of the Diamond Shamrock Company, Dallas, Tex.) or others as are generally known in the art, reduce the amount of air or foam in the emulsion paint. Other additives may optionally be added to the emulsion system such as a solvent selected from the group consisting of methylcarbitol, ethylene glycol, propylene glycol and mixtures thereof forming from about 2½ to about 4½% by weight of the total emulsion system; tinting pigments, as are known in the art, forming from 0 to about 5% of the emulsion system; preservatives, as are known in the art, forming about 0.25% by weight of the emulsion system; and thickeners forming about 2 to about 4% by weight of the emulsion system, such as RM-5 (which is an acrylic copolymer product from the Rohm and Hass Co.), hydroxyethylcellulose, carboxymethylcellulose, or others as are known in the art. The methyl carbitol solvent controls the speed of drying with fast drying being desired.

A useful sizing includes a nitrocellulose resin solution in a blend of organic solvents having resin solids content of between 12 and 25 percent by volume.

Heat stable pigments are important to the products and methods described herein. Yellow pigment should be heat stable at least as much as Y155 (where Y155 is a color index name). The orange pigment should be heat stable at least as much as O36 and the red pigment should be heat stable at least as much as R254. The pigments should be stable to heat and not change color in a way that is discernable to the normal human eye under the same illuminant (delta E less than or equal to about 2.3, and preferably less than about 1) when exposed to a temperature of at least about 185° F. for 10 minutes, preferably at least about 200° F. for at least about 10 minutes. Yellow and orange pigments are not generally stable, but particularly useful pigment for use in formulating various colors of custom paint for use on the fan blades include a yellow pigment that will resist burning at temperatures of less than about 240° F. A particular useful yellow pigment is YELLOW 74, C I NAME: PIGMENT YELLOW 74, C.I. NO.: 11741, CAS NO: 6358-31-2, P.H.: 7.0 TO 9.0, BULK VOLUME: 2.25 to 3.50 cc/gm, WATER SOLUBLE: 2.00% Max, OIL ABSORPTION: 30±2 gm/100 gm, MOISTURE CONTENT: 1% Max, SPECIFIC GRAVITY: 1.40. The pigments used in the processes described herein are distinguished from pigments that used heavy metals as part of their composition. These pigments are no longer used as they are considered toxic. These heavy metals include lead, cobalt, chromium, manganese, nickel, arsenic, cadmium as well as transition metals, lanthanides and actinides. Many of the pigments which used heavy metals were heat stable, but with toxicity precluding their use, a problem was created in achieving a double sided fan blade as described herein.

After painting the paper web on both sides as described above, the painted web then is cut to into individual color display blades which are then collated and joined at one end using known techniques. Fastener openings may be cut in the color cards before or after collating. A deck of color cards is fastened together by inserting a fastener device through the color cards such that they are pivotally attached.

What is claimed is:

1. A color display fan deck comprising a plurality of individual fan blades and a fastener which provides pivotal rotation around the fastener, each side of the blades comprising twice sized paper, the paper having a caliper of from about 8 to about 10 mils, paint applied on both sized surfaces of the paper blade, the paint comprising a curable reactive binder and pigment without heavy metals.

2. The color display fan deck of claim 1 wherein the paint is water based paint.

3. The color display fan deck of claim 2 wherein the water based paint has an acrylic binder resin which includes an acrylic polymer or copolymer.

4. A color display fan deck comprising a plurality of individual fan blades and a fastener which provides pivotal rotation around the fastener, each side of the blades comprising twice sized paper, the paper having a caliper of from about 6 to about 12 mils and a basis weight of from about 80 pounds to about 160 pounds, paint applied on both sized surfaces of the paper blade, the paint comprising a water based polymer or copolymer binder and at least one pigment without heavy metals, which pigment will not change color in a way which is discernible to a normal human eye under the same illuminant after being exposed to a temperature of at least about 200° F. for 10 minutes.

5. The color display fan deck of claim 1 wherein the paper has a basis weight of from about 120 to about 145 pounds.

6. The color display fan deck of claim 1 wherein the paint is not a painted sheet of polymeric film or painted polymeric swatch laminated to the blades.

7. The color display fan deck of claim 3 wherein the paint has a ratio of pigment to acrylic binder resin to provide a color variance as measured by a delta E of not greater than about 2.3 when exposed to a temperature of at least about 185° F. for 10 minutes compared to the paint prior to being exposed to the temperature.

8. The color display fan deck of claim 7 wherein the delta E is not greater than about 1.

9. The color display fan deck of claim 4 wherein the paper has a basis weight of from about 120 to about 145 pounds and has a thickness of from about 8 to about 10 mils.

10. The color display fan deck of claim 4 wherein the paint is not a painted sheet of polymeric film or painted polymeric swatch laminated to the blades.

11. The color display fan deck of claim 4 wherein the paint has a ratio of pigment to water based polymer or copolymer binder to provide a color variance as measured by a delta E of not greater than about 2.3 when exposed to a temperature of at least about 200° F. for 10 minutes compared to the paint prior to being exposed to the temperature.

12. The color display fan deck of claim 11 wherein the delta E is not greater than about 1.

* * * * *